US010352666B2

(12) United States Patent
Haas

(10) Patent No.: US 10,352,666 B2
(45) Date of Patent: Jul. 16, 2019

(54) COLLAR FOR A REDUCED DIAMETER BROADHEAD

(71) Applicant: FeraDyne Outdoors, LLC, Superior, WI (US)

(72) Inventor: Matthew Peter Haas, Duluth, MN (US)

(73) Assignee: FeraDyne Outdoors, LLC, Superior, WI (US)

( * ) Notice: Subject to any disclaimer, the term of this patent is extended or adjusted under 35 U.S.C. 154(b) by 0 days.

(21) Appl. No.: 15/793,686

(22) Filed: Oct. 25, 2017

(65) Prior Publication Data

US 2018/0112957 A1 Apr. 26, 2018

Related U.S. Application Data

(60) Provisional application No. 62/412,395, filed on Oct. 25, 2016.

(51) Int. Cl.
*F42B 6/08* (2006.01)
*F42B 12/34* (2006.01)

(52) U.S. Cl.
CPC ..... *F42B 6/08* (2013.01); *F42B 12/34* (2013.01)

(58) Field of Classification Search
CPC ..... F42B 6/08; F42B 12/34
USPC ..... 473/583
See application file for complete search history.

(56) References Cited

U.S. PATENT DOCUMENTS

| | | | | |
|---|---|---|---|---|
| 5,417,440 | A * | 5/1995 | Barrie | F42B 6/08 473/584 |
| 8,182,378 | B1 * | 5/2012 | Futtere | F42B 6/08 473/583 |
| 8,449,416 | B2 * | 5/2013 | Grace | F42B 6/08 473/583 |
| 8,758,176 | B2 * | 6/2014 | Pedersen | F42B 6/08 473/583 |
| 9,170,078 | B2 * | 10/2015 | Pedersen | F42B 12/34 |
| 9,228,813 | B1 * | 1/2016 | Pedersen | F42B 6/08 |
| 9,341,449 | B2 * | 5/2016 | Pedersen | F42B 6/08 |
| 9,404,722 | B2 * | 8/2016 | Pedersen | F42B 12/34 |
| 9,605,933 | B2 * | 3/2017 | Pedersen | F42B 12/34 |
| 9,803,962 | B2 * | 10/2017 | Hahn | F42B 6/08 |
| 9,976,835 | B2 * | 5/2018 | Pedersen | F42B 6/08 |
| 10,012,486 | B2 * | 7/2018 | Pedersen | F42B 6/08 |
| 10,030,949 | B1 * | 7/2018 | Grace | F42B 6/08 |

(Continued)

*Primary Examiner* — Alexander R Niconovich
(74) *Attorney, Agent, or Firm* — Greenberg Traurig, LLP; Dipak J. Shah

(57) ABSTRACT

The disclosure relates to a collar for a reduced diameter broadhead wherein a diameter of a ferrule of the broadhead is relatively smaller than an outside diameter of a shaft of an arrow or crossbow bolt to which the broadhead is attached. The collar includes a plurality of spaced-apart tabs, each configured for retaining at least one of a plurality of blades in a retracted position during flight and permitting the retained blade to deploy after the broadhead impacts the target. An outside diameter of the collar at a distal end thereof is substantially equal to the diameter of the ferrule, and an outside diameter of the collar at a proximal end thereof is substantially equal to the outside diameter of the shaft. An outside surface of the collar at the distal end thereof is substantially flush with an outside surface of the ferrule.

24 Claims, 16 Drawing Sheets

(56) References Cited

U.S. PATENT DOCUMENTS

| | | | | |
|---|---|---|---|---|
| 2002/0098926 | A1* | 7/2002 | Liechty, II | F42B 6/08 473/583 |
| 2012/0178560 | A1* | 7/2012 | Grace | F42B 6/08 473/583 |
| 2013/0190112 | A1* | 7/2013 | Pedersen | F42B 6/08 473/583 |
| 2014/0179467 | A1* | 6/2014 | Pedersen | F42B 6/08 473/583 |
| 2014/0248459 | A1* | 9/2014 | Pedersen | F42B 6/08 428/43 |
| 2015/0168109 | A1* | 6/2015 | Pedersen | F42B 12/34 473/583 |
| 2015/0168113 | A1* | 6/2015 | Pedersen | F42B 6/08 473/583 |
| 2016/0010962 | A1* | 1/2016 | Pedersen | F42B 12/34 473/583 |
| 2016/0025466 | A1* | 1/2016 | Pedersen | F42B 6/08 473/583 |
| 2016/0076863 | A1* | 3/2016 | Pedersen | F42B 6/08 473/583 |
| 2016/0273892 | A1* | 9/2016 | Pedersen | F42B 6/08 |
| 2016/0273893 | A1* | 9/2016 | Pedersen | F42B 6/08 |
| 2018/0112956 | A1* | 4/2018 | Haas | F42B 6/08 |

* cited by examiner

COLLAR FOR A REDUCED DIAMETER BROADHEAD

CROSS-REFERENCE TO RELATED APPLICATIONS

This application claims the benefit of U.S. Provisional Patent Application No. 62/412,395 filed Oct. 25, 2016, the entirety of which is hereby incorporated by reference.

STATEMENT REGARDING FEDERALLY SPONSORED RESEARCH OR DEVELOPMENT

Not applicable.

TECHNICAL FIELD

The instant disclosure relates to broadheads. In particular, the disclosure pertains to a ferrule of a broadhead.

BACKGROUND

In some embodiments of prior art ferrules used in broadheads, the diameter of the ferrule body is substantially the same as the diameter of the shaft of an arrow or crossbow bolt to which the broadhead is attached. As such, the distal end of the shaft and the proximal end of the ferrule body abut and are substantially aligned when the broadhead and the shaft are attached to each other. In certain embodiments of prior art ferrules used in broadheads, the diameter of the ferrule body is relatively smaller than the diameter of the shaft of an arrow or crossbow bolt to which the broadhead is attached. As illustrated in FIG. 1, the base or the shoulder of the ferrule body, i.e., the portion of the ferrule body that abuts the shaft, is typically flared for transitioning from the smaller diameter ferrule body to the larger diameter shaft and for providing sufficient surface area for abutting the ferrule body and the shaft. The diameter at the base of the ferrule body is typically the same as or relatively larger than the diameter of the shaft. While some ferrules may have a variety of contours on their external surface, the effective diameter or cross-sectional area remains substantially the same as that of the shaft either throughout the length of the ferrule body and/or at the flared base.

As will be apparent to one skilled in the art, the diameter, and hence the surface area, of the ferrule affects the penetration of the broadhead. Accordingly, there exists a need for a ferrule having a diameter that is relatively smaller than the diameter of the shaft along the entire length of the ferrule.

SUMMARY

A non-limiting exemplary embodiment of a collar for a broadhead includes a distal end, a proximal end, a base, a plurality of spaced-apart tabs, a plurality of spaced-apart inwardly sloping walls, and one or more groove guides disposed on at least a portion of an inside surface of the collar. In some embodiments, the base is defined at least in part by a distal end and a wall extending between the proximal end of the collar and the distal end of the base, wherein the wall includes an inside surface and an outside surface. In certain embodiments, the plurality of spaced-apart tabs extend distally from the distal end of the base, wherein each of the plurality of tabs is configured for retaining at least one of the plurality of deployable blades in a retracted configuration, and permitting the retained blade to deploy after the broadhead impacts a target. In some embodiments, the plurality of spaced-apart inwardly sloping walls extend from the distal end of the base to the distal end of the collar, wherein each of the plurality of walls includes an inside surface and an outside surface. In certain embodiments, the inside surface of the collar is defined at least in part by at least a portion of the inside surface of at least one of the base and the inwardly sloping walls.

DETAILED DESCRIPTION

One or more non-limiting embodiments are described herein with reference to the accompanying drawings, wherein like numerals designate like elements. It should be clearly understood that there is no intent, implied or otherwise, to limit the disclosure in any way, shape or form to the embodiments illustrated and described herein. While multiple exemplary embodiments are provided, variations thereof will become apparent or obvious to a person of ordinary skills. Accordingly, any and all variants for providing functionalities similar to those described herein are considered as being within the metes and bounds of the instant disclosure.

Figure 1:
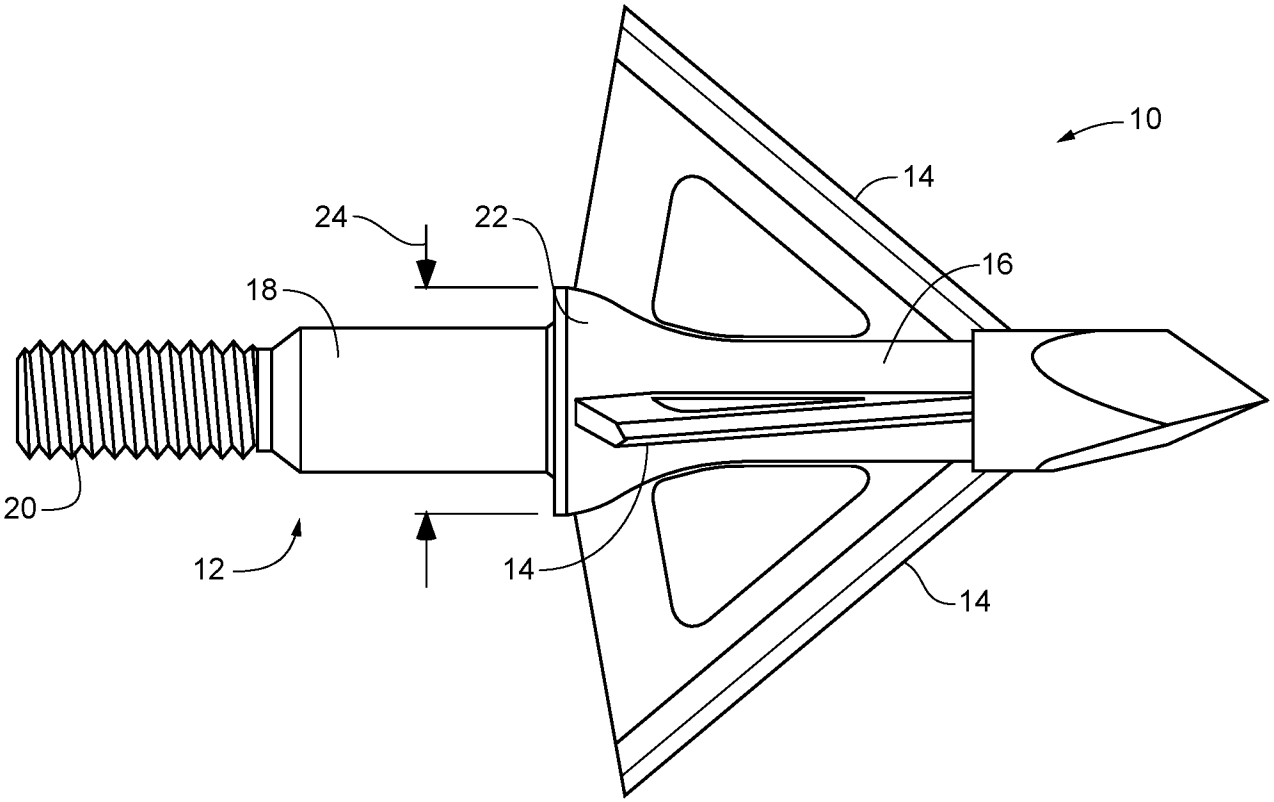
FIG. 1 Prior Art
FIG. 1 is a plan view of a prior art broadhead.

FIG. 1 is a plan view of a prior art broadhead 10 having a ferrule 12 and a plurality of blades 14. The ferrule 12 includes a distal section 16, an intermediate section 18 extending proximally from the distal section 16, and a proximal section 20 extending proximally from the intermediate section 18. In the illustrated embodiment, the diameter of a substantial portion of the ferrule 12 is less than the diameter of a shaft (not shown) of an arrow or crossbow bolt to which the broadhead 10 is attached. For attaching the broadhead 10 to the shaft, a distal section of the shaft is configured for receiving the intermediate section 18 and the proximal section 20 of the broadhead 10. As illustrated, the ferrule 12 includes a flared base or shoulder 22 having a diameter 24 substantially equal to the diameter of the shaft.

Figure 2:
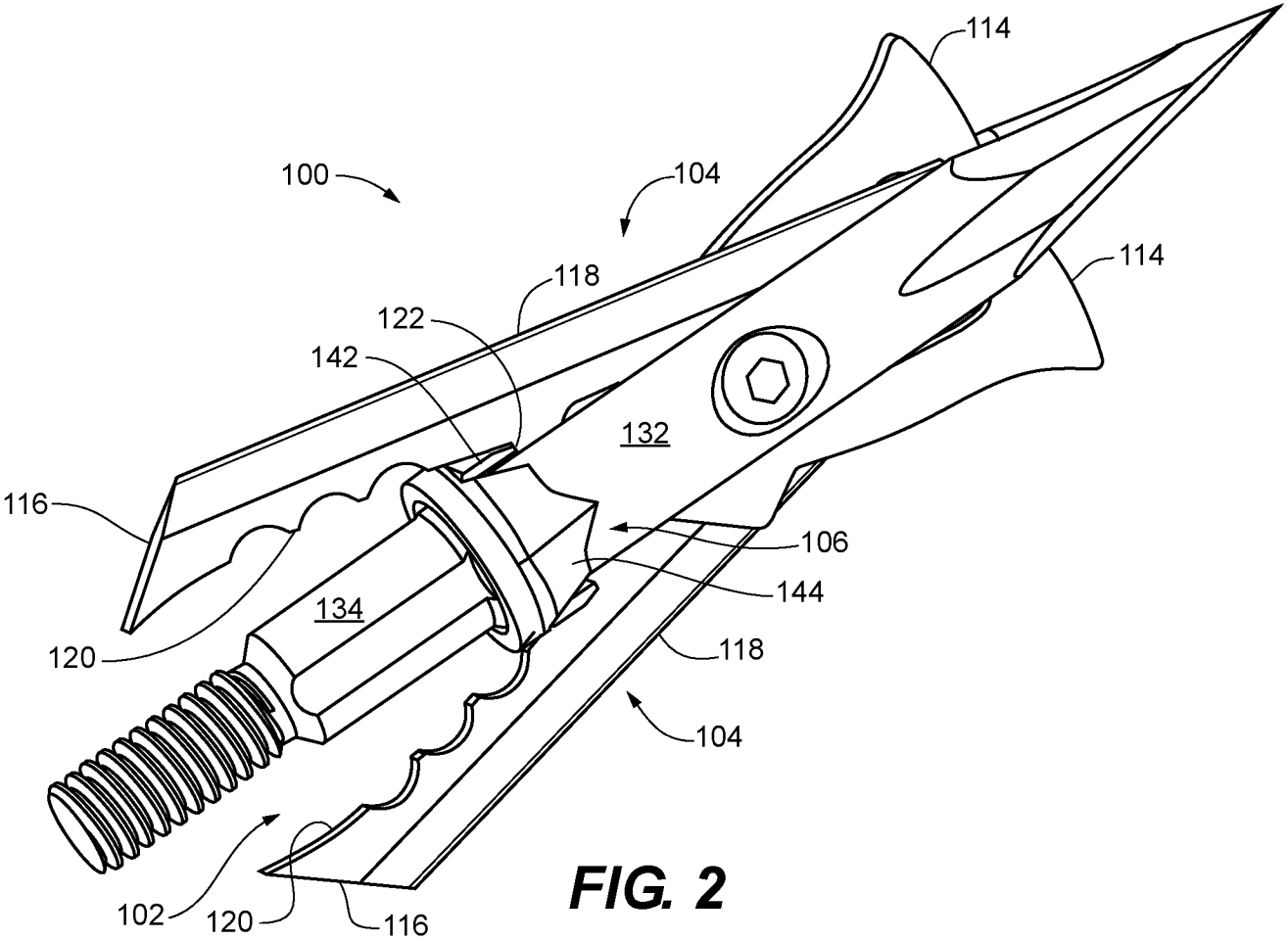
FIG. 2 is a perspective view of a non-limiting exemplary embodiment of a broadhead of the instant disclosure.
Figure 3:
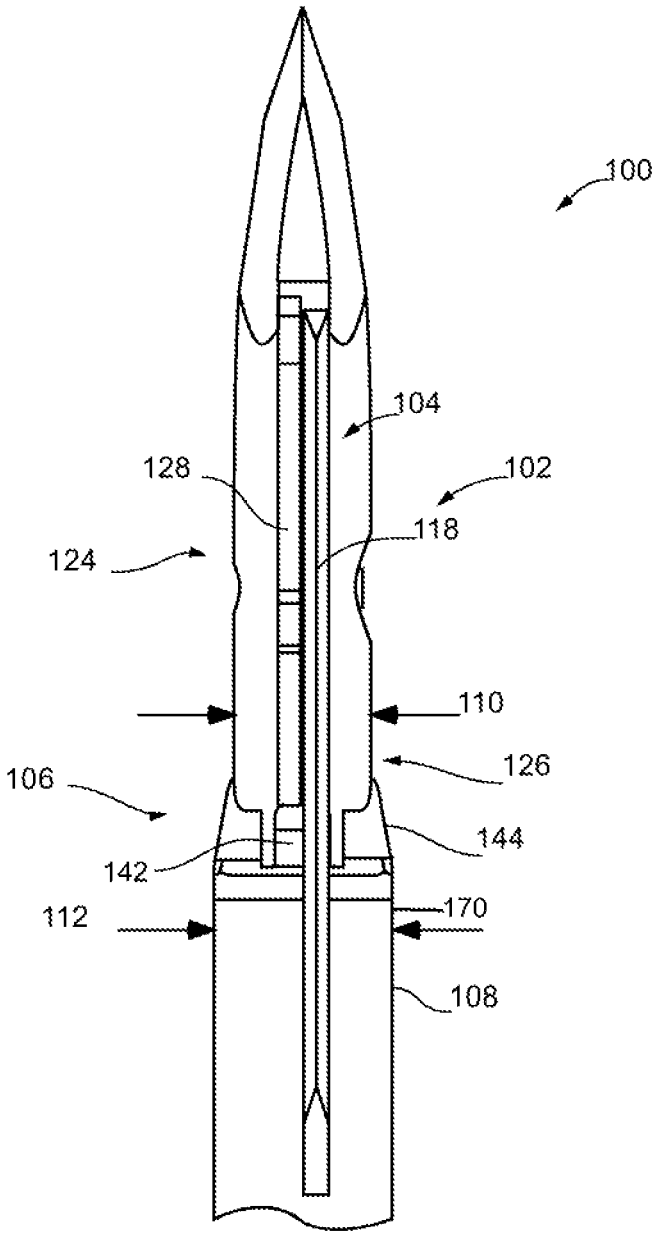
FIG. 3 is a plan view of the broadhead of FIG. 2.

FIGS. 2 and 3, respectively, are a perspective view and a plan view of a non-limiting exemplary embodiment of a broadhead 100 of the instant disclosure. The broadhead 100 includes a ferrule 102, a plurality of deployable blades 104, and a collar 106. In these figures, the blades 104 are illustrated in a retracted configuration, for example during flight. FIG. 3 illustrates the broadhead 100 attached to a shaft 108 of an arrow or crossbow bolt. In some embodiments, a diameter 110 of the broadhead 100, and the diameter of the ferrule 102 in particular, is relatively smaller than a diameter 112 of the shaft 108.

Figure 4:
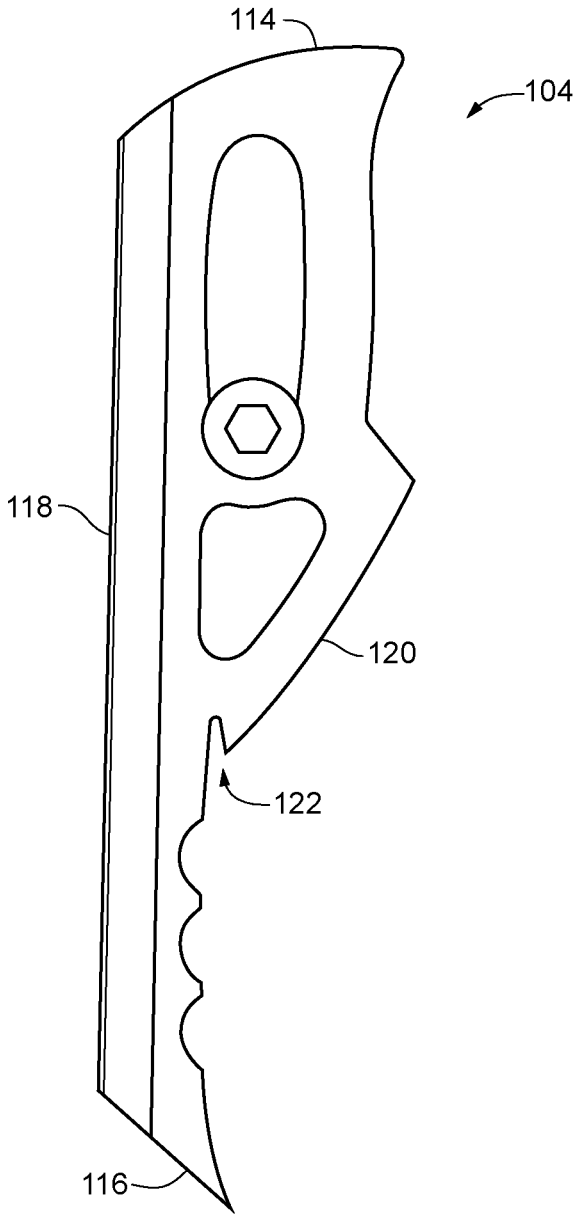
FIG. 4 is a plan view of a non-limiting exemplary embodiment of a blade of the broadhead of FIG. 2.
Figure 8:
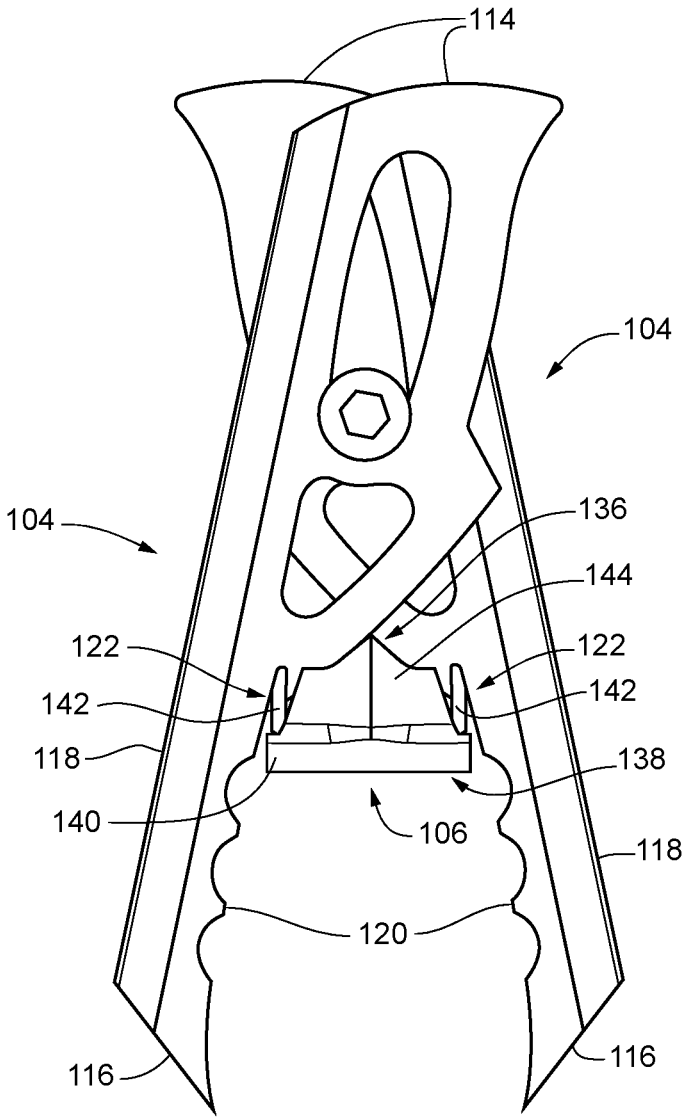
FIG. 8 is a plan view illustrating the blades of FIG. 4 retained in a retracted configuration by the collar of FIG. 7A.

FIG. 4 is a plan view of a non-limiting exemplary embodiment of the blade 104. In some embodiments, the blade 104 is defined at least in part by a leading edge 114, a trailing edge 116, a cutting edge 118, and an inside edge 120. In certain embodiments, the inside edge 120 of the blade 104 includes at least one notch 122 which, as will be explained in further detail with reference to the collar 106 and FIG. 8, is used for retaining the blade 104 in a retracted configuration.

Figure 5:
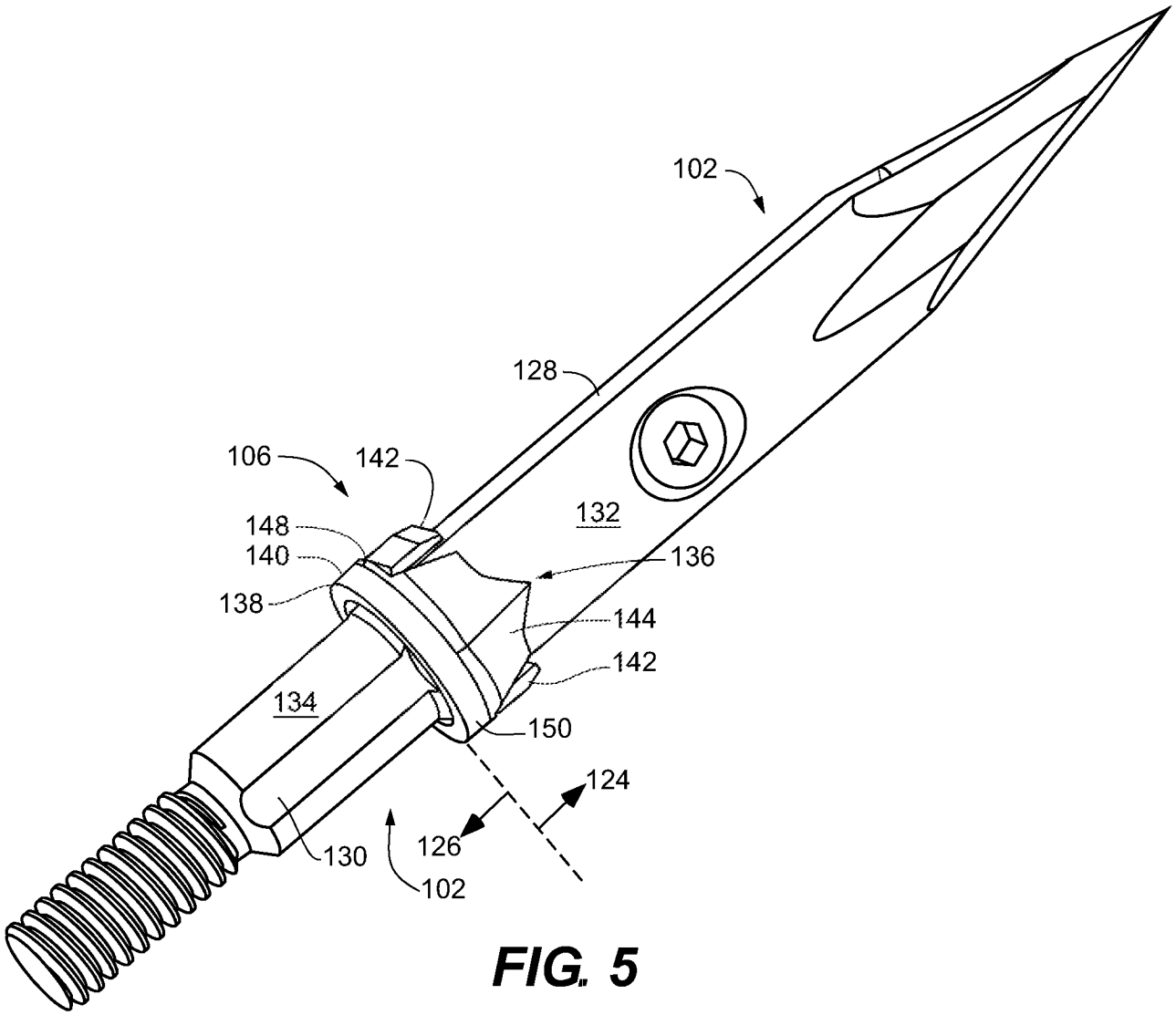
FIG. 5 illustrates the broadhead of FIG. 2 without the blades.

FIG. 5 is a perspective view of the broadhead 100 without the blades 104.

Figure 6A:
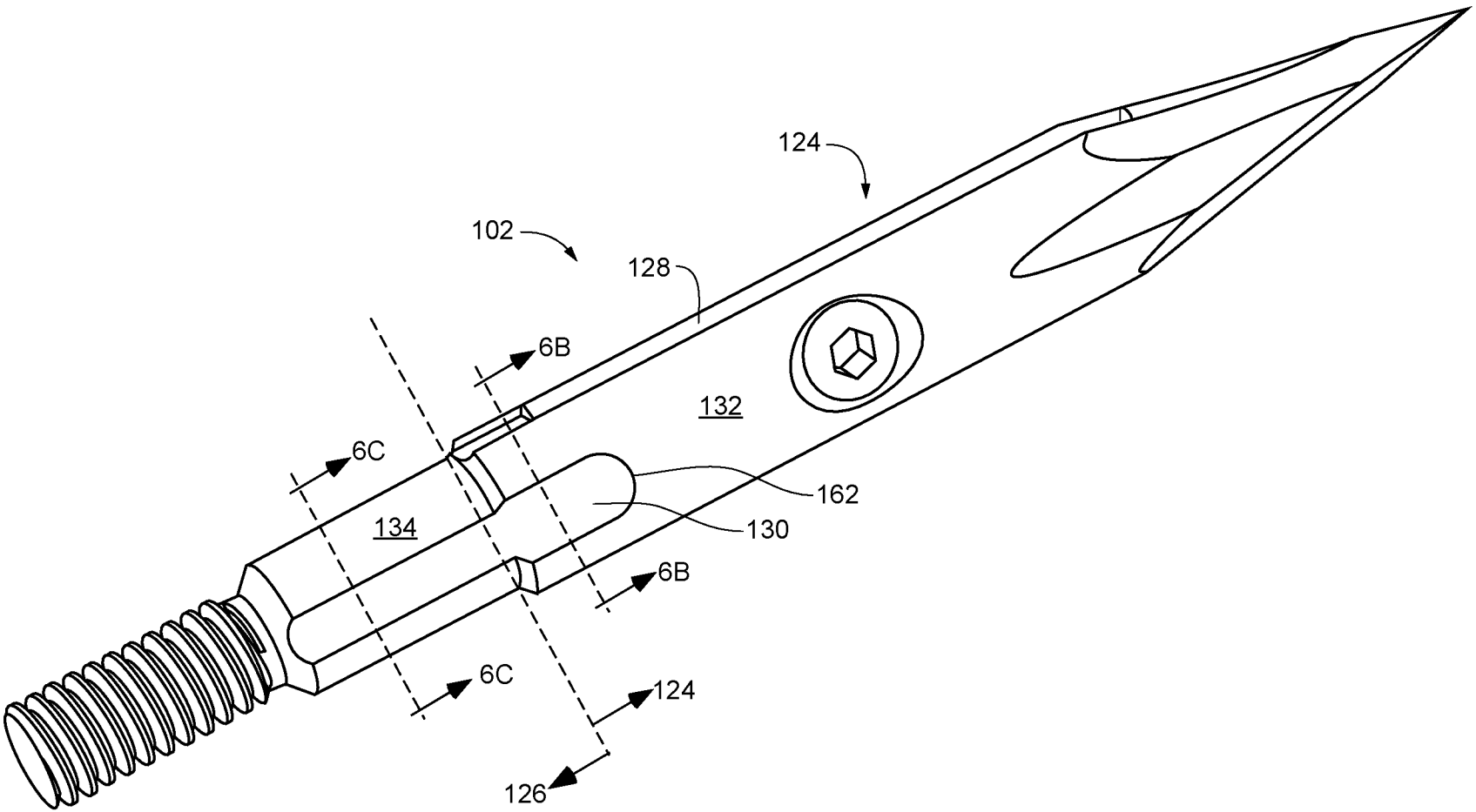
FIG. 6A is a perspective view of a non-limiting exemplary embodiment of a ferrule of the broadhead of FIG. 2.
Figure 6B:
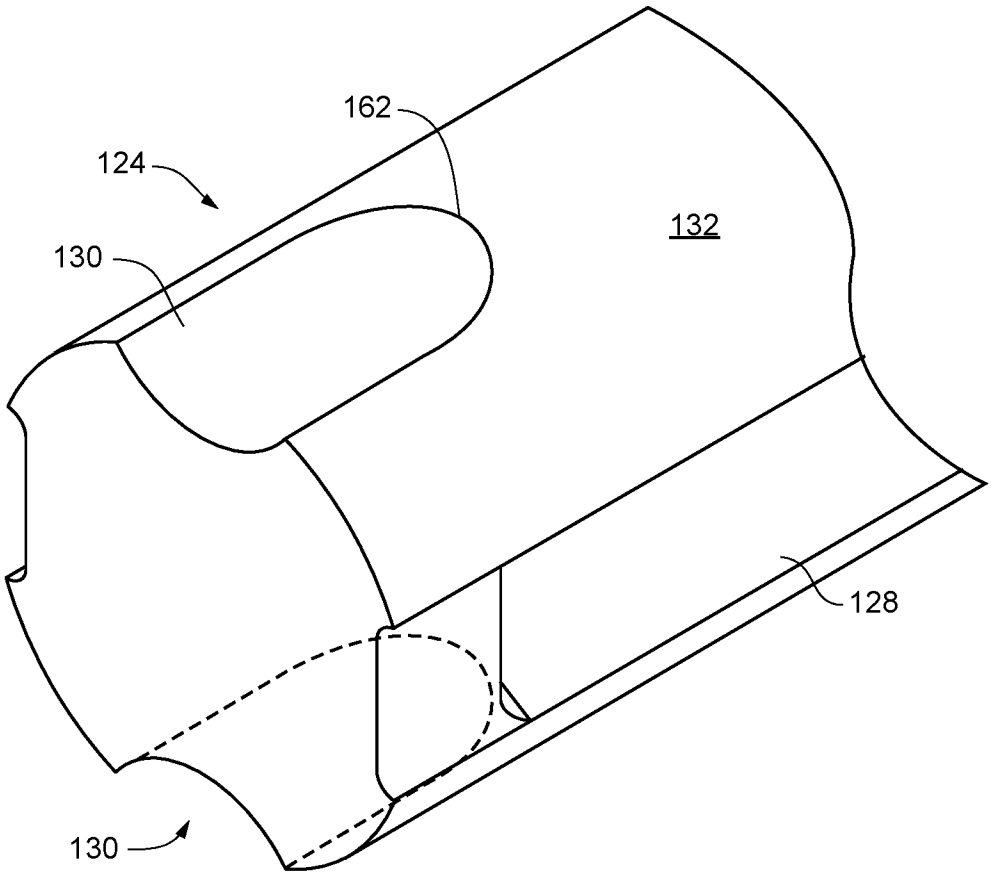
FIG. 6B is a cross-sectional view of the ferrule of FIG. 6A along the line 6B-6B.
Figure 6C:
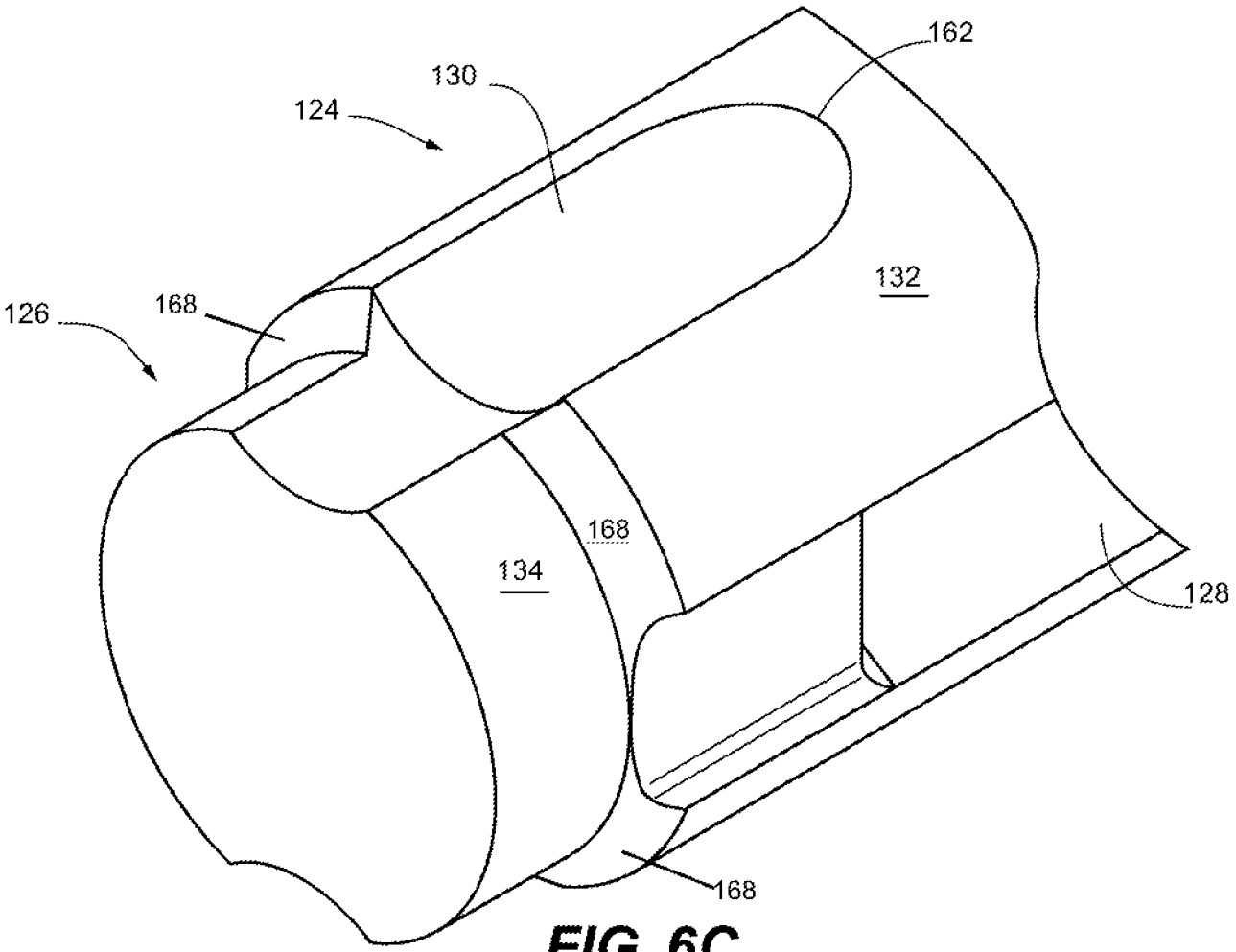
FIG. 6C is a cross-sectional view of the ferrule of FIG. 6A along the line 6C-6C.

FIG. 6A is a perspective view of a non-limiting exemplary embodiment of the ferrule 102. In some embodiments, the ferrule 102 includes a distal section 124, and an intermediate section 126 extending proximally from the distal section 124. FIG. 6B is a cross-sectional view of the distal section 124 of the ferrule 102 of FIG. 6A along line 6B-6B; and FIG. 6C is a cross-sectional view of the intermediate section 126 of the ferrule 102 of FIG. 6A along line 6C-6C. In certain embodiments, the distal section 124 includes at least one blade recess 128 configured for housing at least a portion of the blades 104. In some embodiments, the distal section 124 includes one or more grooves 130 in at least a portion of an outside surface 132 of the distal section 124 and extending distally from the intermediate section 126. In certain embodiments, the one or more grooves 130 extend proximally in at least a portion of an outside surface 134 of the intermediate section 126.

Figure 7A:
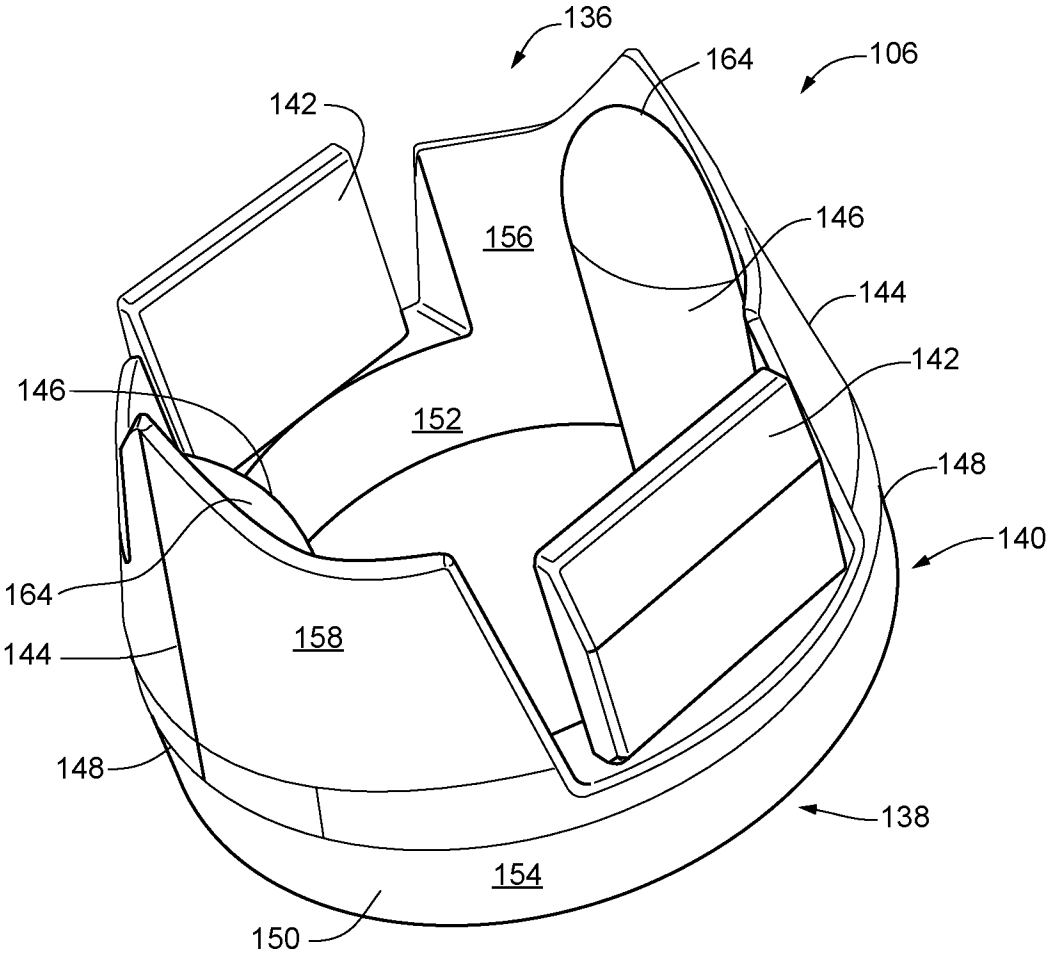
FIG. 7A is a perspective view of a non-limiting exemplary embodiment of a collar of the broadhead of FIG. 2.
Figure 7B:
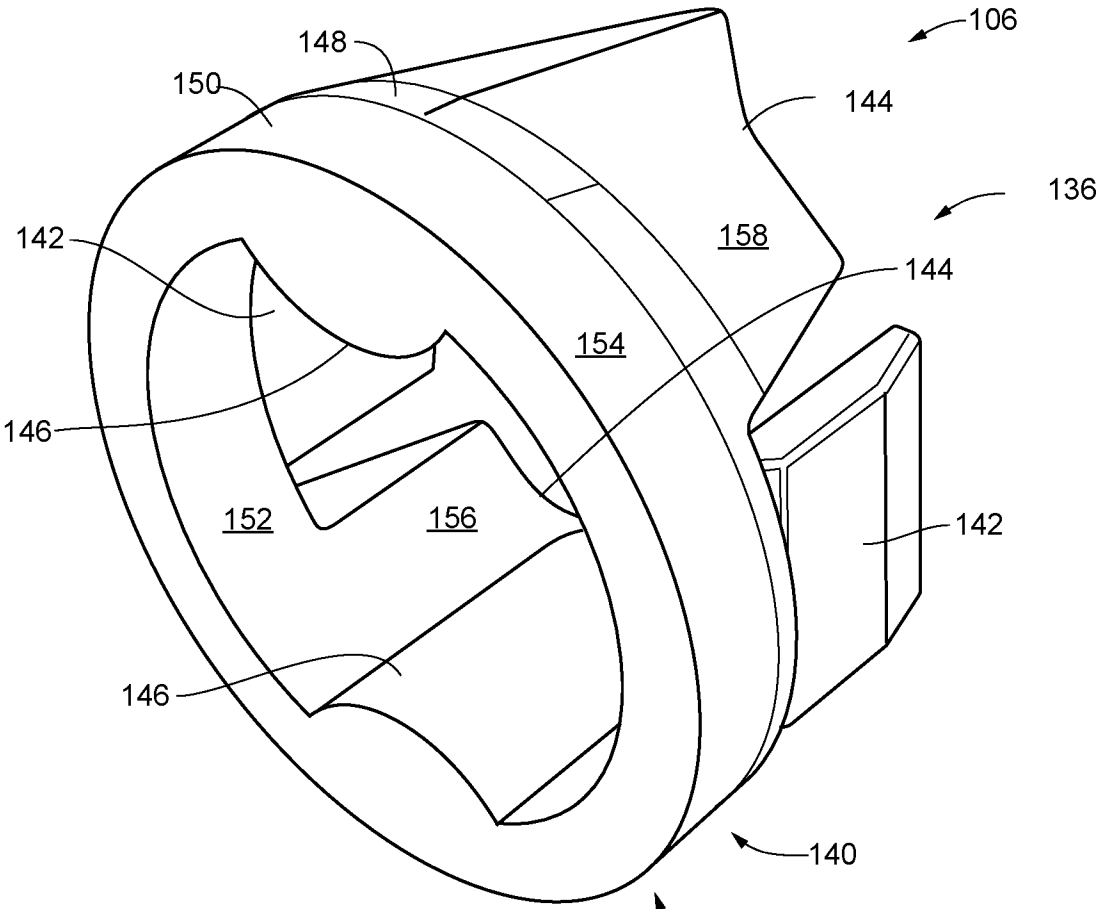
FIG. 7B is an isometric view of the collar of FIG. 7A.
Figure 7C:
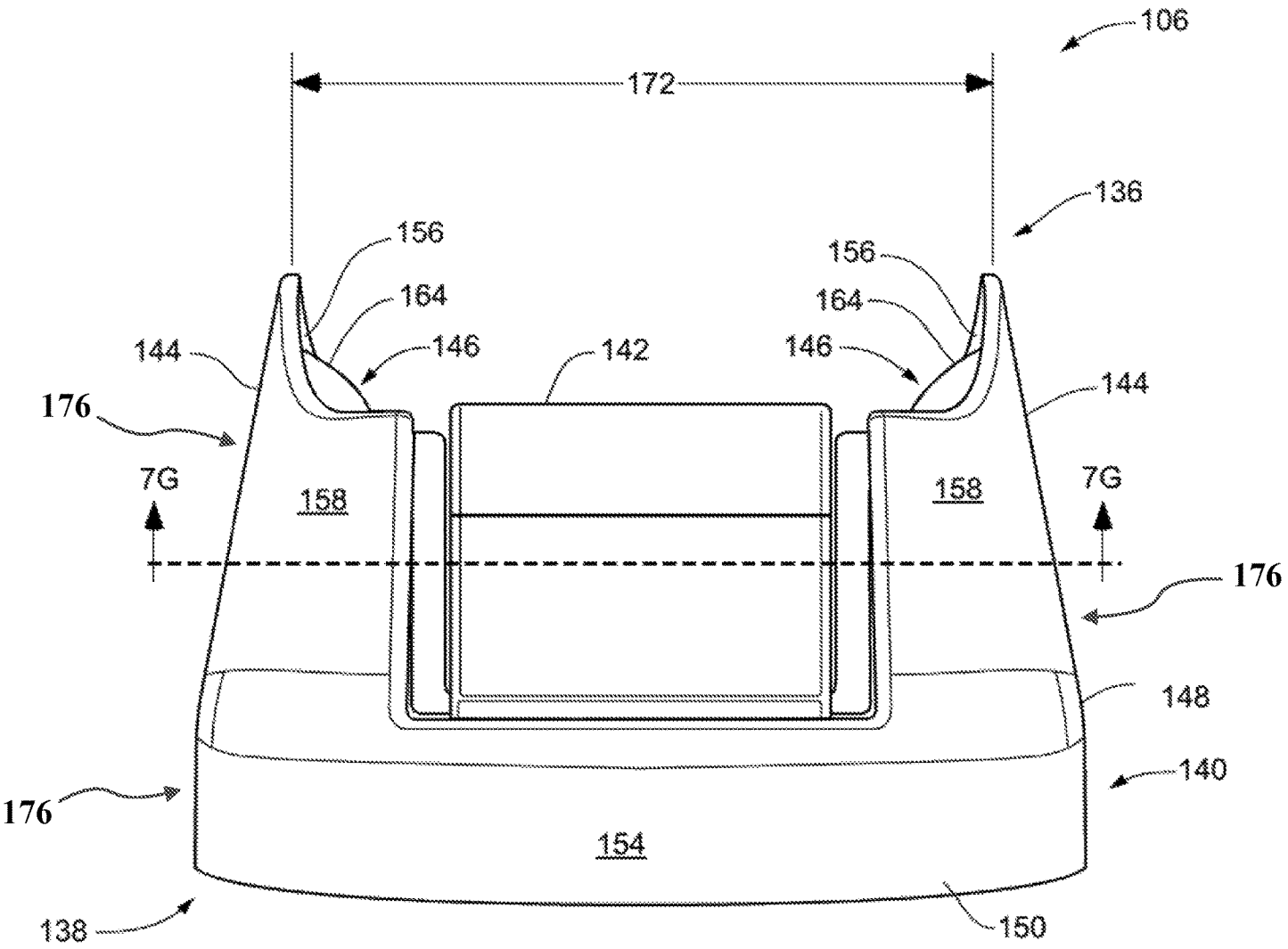
FIG. 7C is an elevation of the collar of FIG. 7A.
Figure 7D:
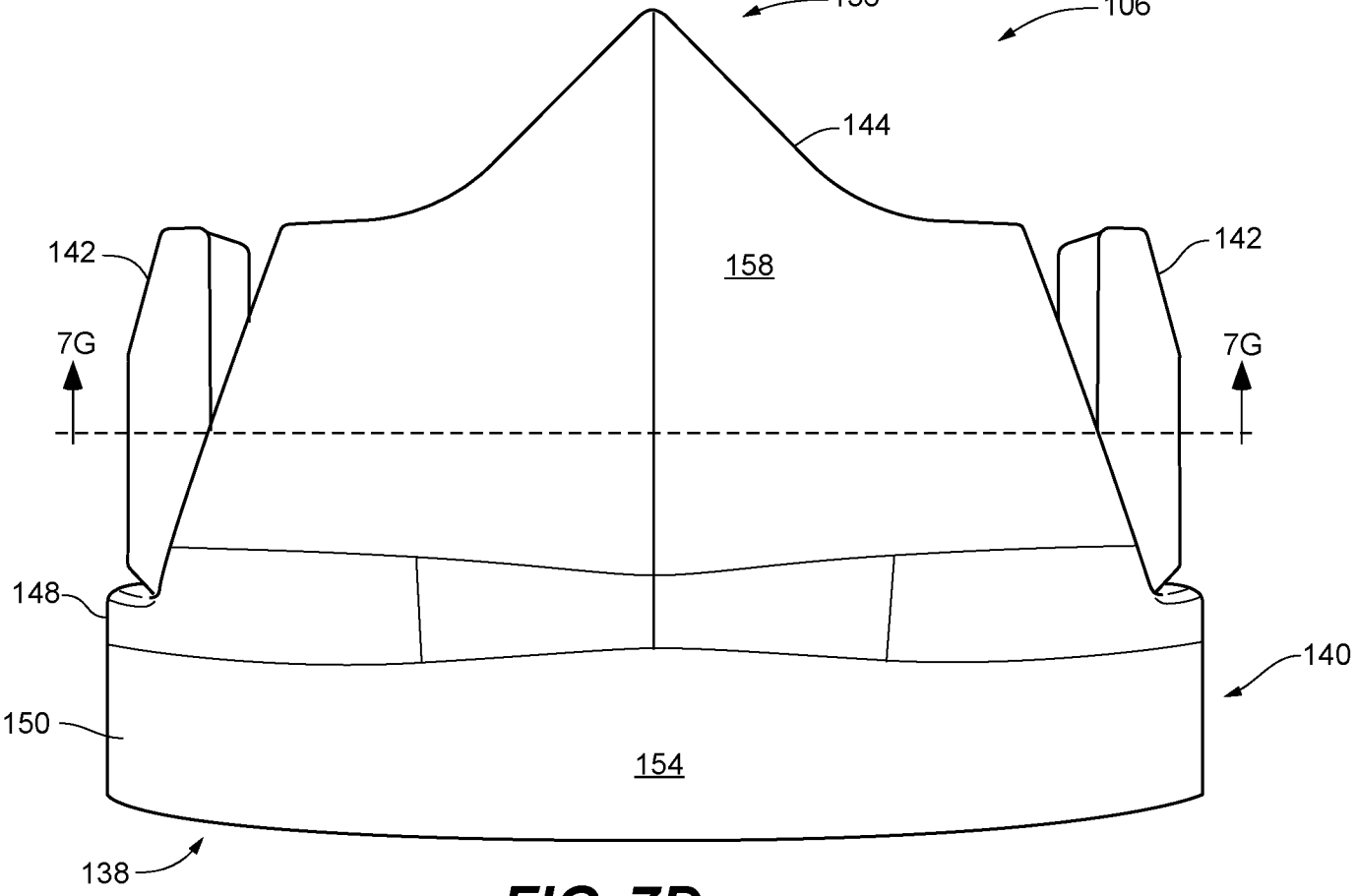
FIG. 7D is an elevation of the collar of FIG. 7A viewed orthogonally from the elevation of FIG. 7C.
Figure 7E:
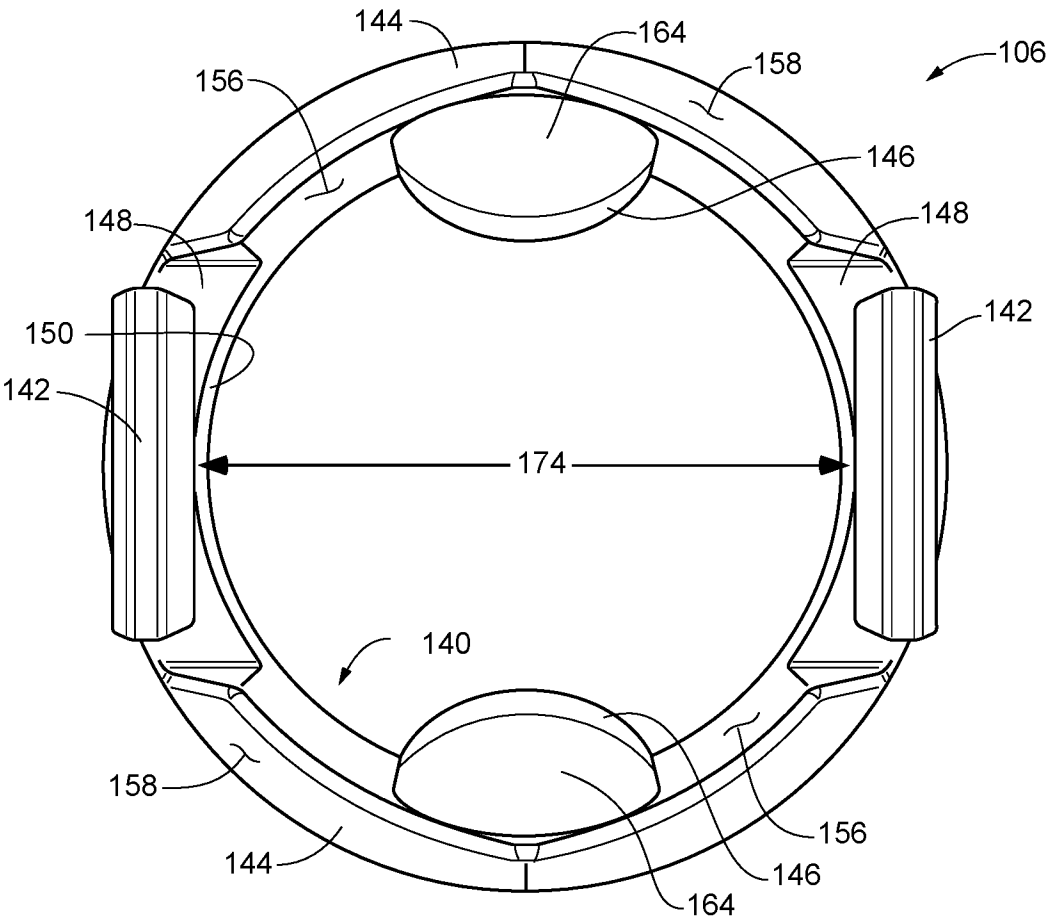
FIG. 7E is a top view of the collar of FIG. 7A.
Figure 7F:
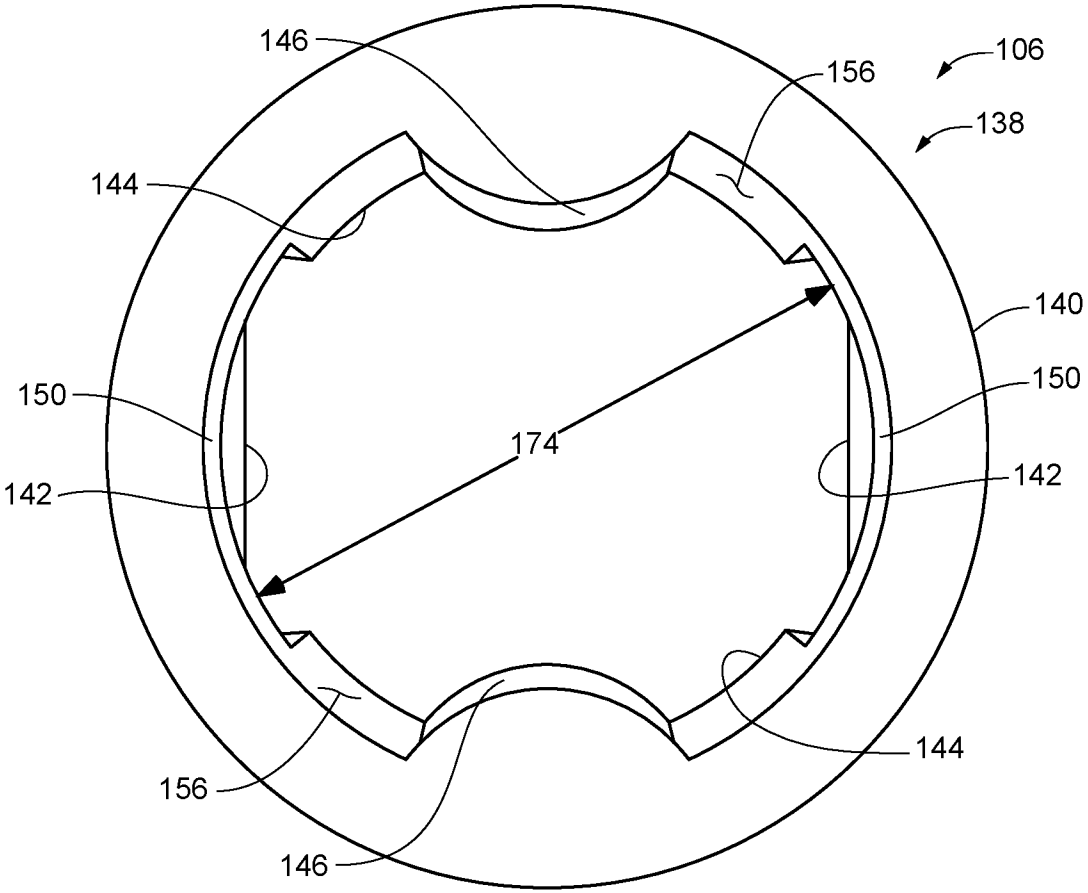
FIG. 7F is a bottom view of the collar of FIG. 7A.
Figure 7G:
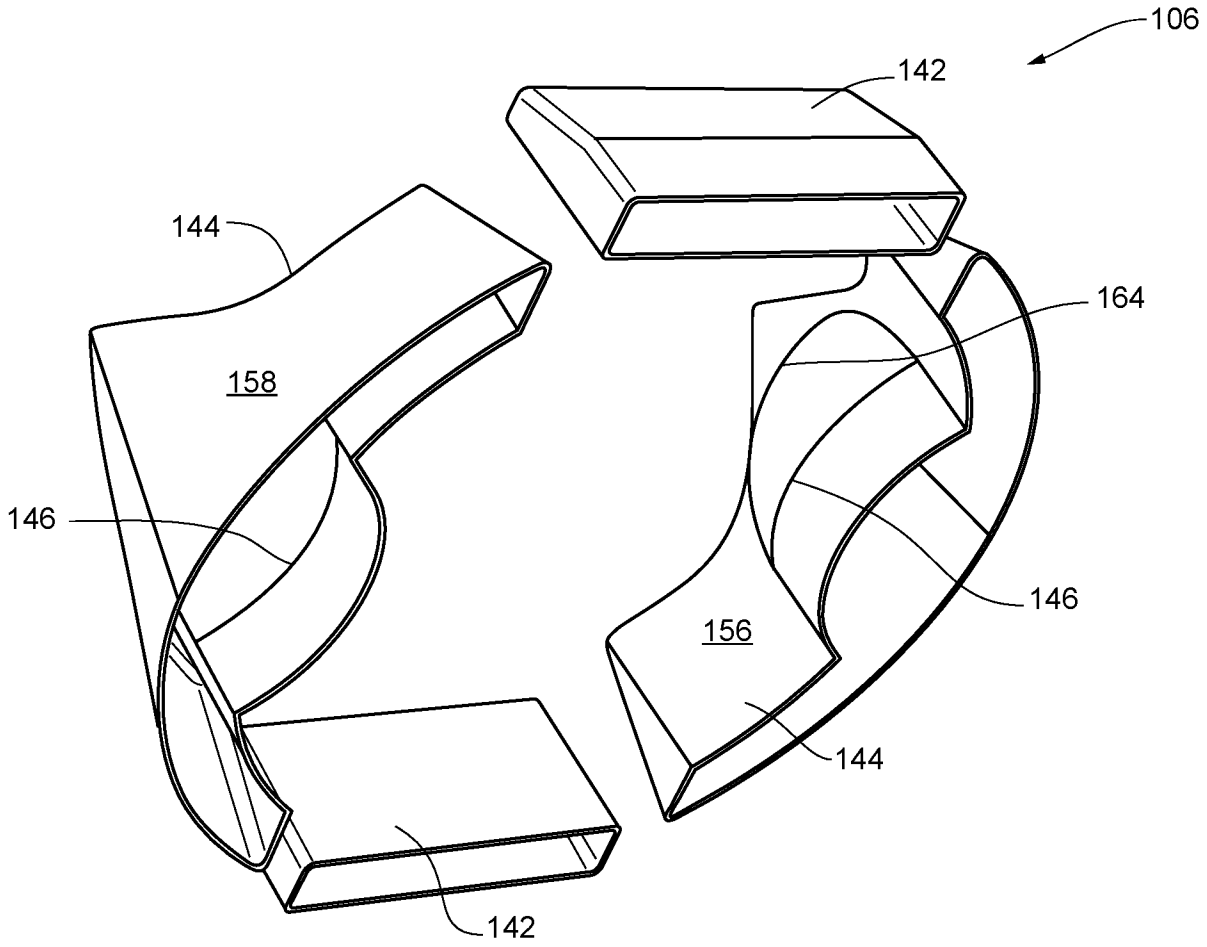
FIG. 7G is a cross-sectional perspective view of the collar of FIG. 7A along line 7G-7G shown in FIGS. 7C and 7D.

FIG. 7A is a perspective view of a non-limiting exemplary embodiment of the collar 106; FIG. 7B is an isometric view of the collar 106; FIGS. 7C and 7D are elevation views of the collar 106, the views being orthogonal relative to each other; FIGS. 7E and 7F, respectively, are top and bottom views of the collar 106; and FIG. 7G is a cross-sectional perspective view of the collar of FIG. 7A along line 7G-7G shown in FIGS. 7C and 7D. In some embodiments, the collar 106 is defined at least in part by a distal end 136, a proximal end 138, a base 140, a plurality of spaced-apart tabs 142, a plurality of spaced-apart inwardly sloping walls 144, and one or more groove guides 146. In certain embodiments, the base 140 is defined at least in part by a distal end 148 and a wall 150 extending between the proximal end 138 of the collar 106 and the distal end 148 of the base 140. In some embodiments, the wall 150 includes an inside surface 152 and an outside surface 154. In certain embodiments, perhaps as best illustrated in FIG. 8, the spaced-apart tabs 142 extend distally from the distal end 148 of the base 140, wherein each tab 142 is configured to extend into at least a portion of the notch 122 of the corresponding blade 104 for retaining the blade 104 in a retracted configuration, for example during flight, and permitting the retained blade 104 to deploy when the broadhead 100 impacts a target. In some embodiments, the spaced-apart inwardly sloping walls 144 extend from the distal end 148 of the base 140 to the distal end 136 of the collar 106. In certain embodiments, the inwardly sloping walls 144 include an inside surface 156 and an outside surface 158. In some embodiments, the one or more groove guides 146 are disposed on at least a portion of an inside surface 160 of the collar 106.

In a non-limiting exemplary embodiment, the inside surface 160 of the collar 106 is defined at least in part by at least a portion of the respective inside surfaces 152 and 156 of at least one of the base 140 and the inwardly sloping walls 144. In some embodiments, the inside surface 160 of the collar 106 is substantially contiguous along the longitudinal extent of the collar 106, i.e., between the proximal and distal ends 138 and 136 of the collar 106. In certain embodiments, the inside surface 160 of the collar 106 extends between the proximal and distal ends 138 and 136 of the collar 106.

In a non-limiting exemplary embodiment, the one or more grooves 130 and the one or more groove guides 146 are configured for engagement with each other. In some embodiments, the one or more grooves 130 and the one or more groove guides 146 are configured for sliding engagement. Accordingly, in certain embodiments, the one or more grooves 130 and the one or more groove guides 146 have complimentary configurations. In certain embodiments, a distal end 162 of the one or more grooves 130 is configured as a stop for a distal end 164 of the one or more groove guides 146. In some embodiments, such as the exemplary embodiment illustrated in FIG. 5, when the entirety of the collar 106 is positioned over at least a portion of the distal section 124, e.g., over a proximal portion 166 of the distal section 124, a proximal end 168 of the distal section 124 and the proximal end 138 of the collar 106 are substantially aligned with each other. In certain embodiments, an outside diameter at the proximal end 138 of the collar 106 (and of the base 140) is substantially equal to an outside diameter at a distal end 170 of the shaft 108. Accordingly, when the broadhead 100 and the shaft 108 are attached, the distal end 170 of the shaft 108 abuts one or both of the proximal ends 138 and 168, respectively, of the collar 106 and the distal section 124.

In some embodiments, both the inside and outside surfaces 156 and 158, respectively, of the walls 144 are inwardly sloping. As such, a thickness of the inwardly sloping walls 144 is substantially constant along a longitudinal extent of the collar 106, i.e., between the distal end 148 of the base 140 and the distal end 136 of the collar 106. In certain embodiments, only the outside surface 158 of the wall 144 is inwardly sloping while the inside surface 156 is substantially straight along the entire longitudinal extent of the walls 144. In one such embodiment, a thickness of the inwardly sloping walls 144 decreases along the longitudinal extent of the walls 144, i.e., between the distal end 148 of the base 140 and the distal end 136 of the collar 106. As such, the thickness of the inwardly sloping wall at the distal end 148 of the base 140 will be relatively greater than the thickness of the inwardly sloping wall at the distal end 136 of the collar 106.

In some embodiments, an inside diameter 172 at the distal end 136 of the collar 106 is substantially equal to the diameter 110 of the ferrule 102. In certain embodiments, an inside diameter 174 at the proximal end 138 of the collar 106 is substantially equal to the diameter 110 of the ferrule 102. In a non-limiting exemplary embodiment, both inside diameters 172 and 174 of the collar are substantially equal to the diameter 110 of the ferrule 102. In some embodiments, the inside diameter of the collar 106 is substantially the same along the entire longitudinal extent of the collar 106, i.e., between the proximal and distal ends 138 and 136 of the collar 106. In certain embodiments, the inside diameter of the collar 106 is substantially equal to the diameter 110 of the ferrule 102 along the entire longitudinal extent of the collar 106, i.e., between the proximal and distal ends 138 and 136 of the collar 106. In some embodiments, an inside diameter at one or more locations along the longitudinal extent of the collar 106 is substantially equal to the diameter 110 of the ferrule 102.

In a non-limiting exemplary embodiment, an outside diameter of the collar 106 at the distal end 136 is substantially equal to the diameter 110 of the ferrule 102. In other words, the distal end 136 of the collar 106 is substantially flush with the outside surface 132 of the distal section 124.

In a non-limiting exemplary embodiment, such as for example illustrated in FIGS. 7A-7G, the one or more groove guides 146 are disposed on at least a portion of each inside surfaces 152 and 156, respectively, of the base 140 and the inwardly sloping walls 144, and extend between the proximal end 138 of the collar 106 and a location proximate the distal end of the collar 106. In some embodiments, the one or more groove guides 146 are disposed on at least a portion of the inside surface 152 of the base 140. In certain embodiments, the one or more groove guides 146 are disposed on at least a portion of the inside surface 156 of the inwardly sloping walls 144.

In some embodiments, the distance between the vertices of the one or more groove guides 146 and the portions of the inside surface 160 of the collar 106 on which the one or more grooves guides 146 are disposed is substantially the same along the longitudinal extent of the one or more groove guides 146. In certain embodiments, the distance between the vertices of the one or more groove guides 146 and the portions of the inside surface 160 of the collar 106 on which the one or more grooves guides 146 are disposed decreases distally, i.e., in the distal direction. In some embodiments, the distance between the vertices of the one or more groove guides 146 and the portions of the inside surface 160 of the collar 106 on which the one or more grooves guides 146 are disposed increases distally. In some embodiments, the one or more groves guides 146 disposed on at least a portion of the inside surface 160 of the collar 106 are contiguous. In certain embodiments, portions or sections of the one or more groves guides 146 disposed on at least a portion of the inside surface 160 of the collar 106 are not contiguous. As will be readily apparent to one of ordinary skill, the one or more grooves 130, if provided, may also need to be changed to accommodate changes in the corresponding one or more groove guides 146. And, vice versa, the one or more groove guides 146, if provided, may also need to be changed to accommodate changes in the corresponding one or more grooves 130. All variants of the described embodiments pertaining to the one or more groove guides 146 and/or the one or more grooves 130 are considered as being within the metes and bounds of the instant disclosure.

In some embodiments, the distance between the diametrically opposite vertices of two diametrically opposite groove guides 146 is substantially constant along their longitudinal extent. In certain embodiments, the distance between the diametrically opposite vertices of two diametrically opposite groove guides 146 increases distally. In some embodiments, the distance between the diametrically opposite vertices of two diametrically opposite groove guides 146 decreases distally. In certain embodiments, the distance between the diametrically opposite vertices of two diametrically opposite groove guides 146 varies along their longitudinal extent. As will be readily apparent to one of ordinary skill, the one or more grooves 130, if provided, may also need to be changed to accommodate changes in the corresponding one or more groove guides 146. And, vice versa, the one or more groove guides 146, if provided, may also need to be changed to accommodate changes in the corresponding one or more grooves 130. All variants of the described embodiments pertaining to the one or more groove guides 146 and/or the one or more grooves 130 are considered as being within the metes and bounds of the instant disclosure.

In a non-limiting exemplary embodiment, the inside diameter of the collar 106 is defined at least in part by the vertices of the one or more groove guides 146. In a non-limiting exemplary embodiment, the one or more groove guides 146 function or operate as a "guide" for at least a portion of the distal section inserted in the collar. In one such embodiment, the distal section may or may not have one or more grooves.

In a non-limiting exemplary embodiment, an outside surface 176 of the collar 106 is defined at least in part by at least a portion of the respective outside surfaces 154 and 158 of at least one of the base 140 and the inwardly sloping walls 144. In some embodiments, the outside surface 176 of the collar 106 is substantially contiguous along the longitudinal extent of the collar 106, i.e., between the proximal and distal ends 138 and 136 of the collar 106. In certain embodiments, the outside surface 176 of the collar 106 is relatively smooth.

In view of the foregoing, it will be readily apparent to a person of ordinary skill that the collar 106 is configured to provide a smooth transition between the ferrule 102 and the shaft 108. More particularly, the collar 106 provides a smooth transition between the ferrule 102 having the diameter 110 that is relatively smaller than the diameter 112 of the shaft 108.

In a non-limiting exemplary embodiment, the plurality of spaced-apart tabs 142 are configured to extend into at least a portion of the notch 122 of the respective blade 104 for retaining the blade 104 in a retracted configuration. When the projectile, i.e., arrow or crossbow bolt, impacts and starts penetrating the target, the leading edges 114 of the blades 104 impact the target, and the blades 104 translate in the proximal direction due to the kinetic energy of the projectile. This movement of the blades 104 exerts an outward force or pressure on the tabs 142. In some embodiments, the tabs 142 are frangible and the outward force causes them to break off of the base 140 of the collar 106, and permit the blades 104 to deploy. In certain embodiments, the plurality of spaced-apart tabs 142 are hingedly or flexibly connected to the base 140 such that they bend or flex outwards in response to the outward force and permit the blades 104 to deploy. In some embodiments, the tabs 142 return to their initial position after the blades 104 have deployed.

In some embodiments, the broadhead does not include any grooves 130 in the distal section 124. In certain embodiments, the broadhead does not include any groove guides 146 on the inside surface 160 of the collar 106. In some embodiments, the broadhead does not include any grooves 130 or any groove guides 146, respectively, in the distal section 124 and on the inside surface 160 of the collar 106.

In some embodiments, the outside diameter at the proximal end 168 of the distal section 124 and the outside diameter at the distal end 170 of the shaft 108 are substantially equal. In certain embodiment, the outside diameter at the proximal end 168 of the distal section 124 is relatively smaller than the outside diameter at the distal end 170 of the shaft 108.

In some embodiments, the diameter of the distal section 124 is substantially the same (or constant) between the proximal and distal ends thereof. In certain embodiments, the diameter of the distal section between the proximal and distal ends thereof is substantially equal to the outside diameter at the distal end of the shaft. In some embodiments, the diameter of the distal section between the proximal and distal ends thereof is relatively smaller than the outside diameter at the distal end of the shaft. In certain embodiments, the diameter of the distal section 124 varies between the proximal and distal ends thereof. In some embodiments, the diameter of the distal section 124 between the proximal and distal ends thereof varies between the diameter at the distal end 170 of the shaft 108 and a diameter relatively smaller than the diameter at the distal end 170 of the shaft 108.

In some embodiments, the diameter of the distal section 124 increases distally between the proximal and distal ends thereof. In certain embodiments, the diameter at the proximal end of the distal section 124 is relatively smaller than the diameter at the distal end of the shaft, and increases distally, i.e., in the distal direction, (or decreases proximally) between the proximal and distal ends thereof. In some embodiments, the diameter of the distal section 124 decreases distally (or increases proximally) between the proximal and distal ends thereof. In some embodiments, the diameter at the proximal end of the distal section 124 is substantially equal to the diameter at the distal end 170 of the shaft 108 and the diameter of the distal section 124 decreases distally (or increases proximally) between the proximal and distal ends thereof. In certain embodiments, the diameter at the proximal end of the distal section 124 is relatively smaller than the diameter at the distal end 170 of the shaft 108 and the diameter of the distal section 124 increases distally (or decreases proximally) between the proximal and distal ends thereof.

All variants of the described embodiments pertaining to the diameter of the distal section 124 are considered as being within the metes and bounds of the instant disclosure.

In view thereof, modified and/or alternate configurations of the embodiments described herein may become apparent or obvious to one of ordinary skill. All such variations are considered as being within the metes and bounds of the instant disclosure. For instance, while reference may have been made to particular feature(s) and/or function(s), the disclosure is considered to also include embodiments configured for functioning and/or providing functionalities similar to those disclosed herein with reference to the accompanying drawings. Accordingly, the spirit, scope and intent of the instant disclosure is to embrace all such variations. Consequently, the metes and bounds of the disclosure is solely defined by the appended claims and any and all equivalents thereof.

What is claimed is:

1. A collar for a broadhead, the collar comprising:
a distal end;
a proximal end;
a base defined at least in part by a distal end and a wall extending between the proximal end of the collar and the distal end of the base;
a plurality of spaced-apart tabs extending distally from the distal end of the base, wherein each of the plurality of tabs is configured for
retaining at least one of a plurality of deployable blades of the broadhead in a retracted configuration; and
permitting the retained blade to deploy after the broadhead impacts a target;
a plurality of spaced-apart inwardly sloping walls extending from the distal end of the base to the distal end of the collar; and
one or more groove guides disposed on at least a portion of an inside surface of the collar;
wherein, an outside surface of the collar is substantially contiguous between the proximal and distal ends thereof.

2. The collar of claim 1, wherein a distance between a vertex of the one or more groove guides and the inside surface of the collar on which it is disposed varies along a longitudinal extent thereof.

3. The collar of claim 1, wherein a distance between vertices of two or more groove guides is substantially the same along a longitudinal extent thereof.

4. The collar of claim 1, wherein a distance between vertices of two or more groove guides varies along a longitudinal extent thereof.

5. The collar of claim 1, wherein an inside diameter of the collar is defined at least in part by vertices of the one or more groove guides.

6. The collar of claim 1, wherein
an outside diameter of the collar at the proximal end thereof is substantially equal to an outside diameter at a distal end of a shaft for an arrow or crossbow bolt; and
an outside diameter of the collar at the distal end thereof is substantially equal to a diameter of a ferrule of the broadhead.

7. The collar of claim 6, wherein the diameter of the ferrule is relatively smaller than the outside diameter at the distal end of the shaft.

8. The collar of claim 6, wherein the distal end of the collar is substantially flush with an outside surface of the ferrule.

9. The collar of claim 6, wherein the ferrule, comprises:
a distal section comprising at least one blade recess;
an intermediate section extending proximally from the distal section; and
one or more grooves in at least a portion of an outside surface of the distal section, wherein each of the one or more grooves extends distally from the intermediate section.

10. The collar of claim 9, wherein the one or more grooves and the one or more groove guides have complementary configurations.

11. The collar of claim 9, wherein a distal end of the one or more grooves is configured as a stop for a distal end of the one or more groove guides.

12. The collar of claim 9, wherein a proximal end of the distal section and the proximal end of the collar are substantially aligned when the collar is placed over at least a portion of the distal section.

13. The collar of claim 1, wherein
an outside surface of the collar is defined at least in part by at least a portion of the outside surface of at least one of the base and the inwardly sloping walls; and
the outside surface of the collar provides a substantially smooth transition between a ferrule and a distal end of a shaft for an arrow or crossbow bolt.

14. The collar of claim 1, wherein an inside diameter of the collar is substantially the same between the proximal and distal ends thereof.

15. The collar of claim 1, wherein an inside diameter of the collar varies between the proximal and distal ends thereof.

16. The collar of claim 1, wherein an outside diameter of the collar decreases distally between the proximal and the distal ends thereof.

17. The collar of claim 1, wherein an outside diameter of the collar at the proximal end thereof is substantially equal to an outside diameter at a distal end of a shaft for an arrow or crossbow bolt.

18. The collar of claim 1, wherein an outside diameter of the collar at the distal end thereof is relatively smaller than an outside diameter of the collar at the proximal end thereof.

19. The collar of claim 1, wherein the plurality of tabs are frangible.

20. The collar of claim 1, wherein the plurality of tabs are flexible.

21. The collar of claim 1, wherein the inside surface of the collar is defined at least in part by at least a portion of an inside surface of at least one of the base and the inwardly sloping walls.

22. The collar of claim 1, wherein the proximal end of the collar and a distal end of a shaft for an arrow or crossbow bolt abut when the broadhead and the shaft are attached to each other.

23. The collar of claim 1, wherein an inside diameter of the collar and an outside diameter of a ferrule of the broadhead are substantially equal.

24. The collar of claim 1, wherein an inside diameter of the collar at the distal end thereof and an outside diameter of a ferrule of the broadhead are substantially equal.

* * * * *